US007026749B2

(12) United States Patent
Rho et al.

(10) Patent No.: US 7,026,749 B2
(45) Date of Patent: Apr. 11, 2006

(54) CATHODE FOR ELECTRON TUBE AND METHOD OF PREPARING THE SAME

(75) Inventors: Hwan-Chul Rho, Busan (KR); Seog-Lae Cho, Busan (KR); Hae-Taek Yang, Busan (KR)

(73) Assignee: Samsung SDI Co., Ltd., Suwon-si (KR)

( * ) Notice: Subject to any disclaimer, the term of this patent is extended or adjusted under 35 U.S.C. 154(b) by 85 days.

(21) Appl. No.: 09/925,037

(22) Filed: Aug. 9, 2001

(65) Prior Publication Data

US 2002/0041140 A1 Apr. 11, 2002

(30) Foreign Application Priority Data

Oct. 6, 2000 (KR) ..... 2000-58756

(51) Int. Cl.
*H01J 1/14* (2006.01)

(52) U.S. Cl. ..... 313/346 R; 313/337; 313/346 DC; 313/373

(58) Field of Classification Search ..... 313/346 R, 313/337, 347 DC, 373
See application file for complete search history.

(56) References Cited

U.S. PATENT DOCUMENTS 4,559,281 A * 12/1985 Derfler et al. ..... 428/687
4,587,455 A * 5/1986 Falce et al. ..... 313/346 DC
4,957,463 A * 9/1990 Branovich et al. ..... 445/50
5,122,707 A * 6/1992 Nakanishi et al. ..... 313/346 R
5,726,524 A * 3/1998 Debe ..... 313/309
6,351,061 B1 * 2/2002 Yamauchi et al. ..... 313/346 R
6,376,975 B1 * 4/2002 Nakagawa ..... 313/346 DC
6,376,976 B1 * 4/2002 Saitoh et al. ..... 313/346 R

FOREIGN PATENT DOCUMENTS

JP WO99/59178 * 11/1999 ..... 313/346 R

* cited by examiner

*Primary Examiner*—Mariceli Santiago
*Assistant Examiner*—Anthony Perry
(74) *Attorney, Agent, or Firm*—Robert E. Bushnell, Esq.

(57) ABSTRACT

A cathode for an electron tube and a method of preparing the same are provided. The cathode includes a base metal and an electron emissive material layer attached to the base metal. A surface roughness, which is measured from the distance between a highest point and a lowest point of the surface of the electron emissive material layer, is controlled to be no greater than 8 μm. By controlling the sizes of particles and pores constituting the electron emissive material layer to be uniform and controlling the density and porosity of the electron emissive material layer, the cathode is improved in compactness and surface evenness compared to a cathode prepared according to a spraying method. Accordingly, shrinking of the cathode during operation can be prevented, and the distance between the cathode and a G1 (first grid) electrode can be maintained uniform, so that the life of the cathode can be greatly extended, and a stable electron emission characteristic can be realized.

24 Claims, 6 Drawing Sheets

110

CATHODE FOR ELECTRON TUBE AND METHOD OF PREPARING THE SAME

CLAIM OF PRIORITY

This application makes reference to, incorporates the same herein, and claims all benefits accruing under 35 U.S.C. §119 from an application entitled Cathode for Electron Tube and Preparing Method Therefor earlier filed in the Korean Industrial Property Office on 6 Oct. 2000, and there duly assigned Serial No. 2000-58756 by that Office.

BACKGROUND OF THE INVENTION

1. Field of the Invention

The present invention relates to a cathode for an electron tube and a method of preparing the same, and more particularly, to a cathode which is improved in life and electron emission characteristics by realizing the high density and surface evenness of an electron emissive layer for an electron tube.

2. Description of the Background Art

As a cathode for an electron tube, an oxide cathode is widely used. The oxide cathode includes an electron emissive material layer formed of oxides converted from an alkaline earth metal carbonate containing barium as a main component, and preferably, ternary carbonate having a basic composition of (Ba, Sr, Ca)$CO_3$ or binary carbonate having a basic composition of (Ba, Sr)$CO_3$ is converted, on a base metal containing nickel (Ni) as a main component and slight amounts of silicon (Si) and magnesium (Mg) as reducing agents. Since such an oxide cathode has a low work function, it has an advantage of operating at a relatively low temperature (700–800° C.). However, since the oxide cathode is formed of a semiconductor and has large electrical resistance, its raw material is evaporated or melted by self-heating due to Joule heat when electron emission density is increased, which thus deteriorates the cathode. Moreover, an intermediate resistance layer is formed between the metal base and the oxide layer due to prolonged operation, which shortens the life span of the cathode.

A typical cathode for an electron tube includes a base metal having the shape of a circular plate, a cylindrical sleeve which is provided below the base metal to support the base metal and has a heater, i.e., a heating source of the cathode, therewith, and an electron emissive material layer adhering to the top of the base metal.

The following description concerns a general procedure of preparing an oxide cathode and the principle of electron emission. Carbonate powder containing barium carbonate as a main component is mixed in an organic solvent in which nitrocellulose is dissolved. The resulting mixture is attached to a base metal using a spraying or electrodeposition method. The resulting structure is installed at an electron gun, which is provided in an electron tube. During evacuation for making the inside of the electron tube vacuous, the carbonate is heated to about 1000 degrees Celsius by a heater. Here, the barium carbonate is converted into barium oxide as follows.

$$BaCO_3 \rightarrow BaO + CO_2 \quad (1)$$

The barium oxide reacts with Si and Mg, which is a reductant contained in the base metal, at its boundary contacting the base metal during the operation of a cathode, and is reduced as the following chemical equations, thereby producing free barium. The barium contributes to the emission of electrons.

$$BaO + Mg \rightarrow MgO + Ba \quad (2)$$

$$4BaO + Si \rightarrow Ba_2SiO_4 + 2Ba \quad (3)$$

In preparing a conventional oxide cathode, a spraying method is most widely used as a method of attaching a mixture containing carbonate powder to a base metal. According to the spraying method, the powder of a raw material is dispersed into an organic solvent containing a binder to form a suspension, and the suspension is sprayed using the pressure of air stream flow, thereby accomplishing a coating. Nitrocellulose is used as a binder. Isoamylacetate, diethyloxalate, or pure water is used as a solvent.

However, since a spraying method uses only force sprayed by air pressure without using any other pressure, it is limited in obtaining a uniform and dense coating film. More specifically, the structure of an electron emissive material layer attached by a spraying method is shown in FIGS. 2 and 3. FIG. 2 is an electron microscopy photograph of the section, which is enlarged 200 times, of an electron emissive material layer attached by a spraying method. As shown in FIG. 2, the size of the pore between particles is nonuniform, the surface is very coarse, and the texture is sparse. FIG. 3 is an electron microscopy photograph of the surface texture, which is enlarged 2000 times, of the electron emissive material layer of FIG. 2. It can be confirmed again that the size of the pore between particles is nonuniform.

When a cathode with such an electron missive material layer having nonuniform particle size, pore size and smoothness is installed at an electron gun, defects occurs in a product, and the reliability in quality decreases. In addition, when the surface roughness is large due to the nonuniform particles size, a beam spot becomes smaller, which causes a mask to interfere with the beam spot during operation of a color cathode-ray tube, resulting in a moire phenomenon. Generally, in a cathode having a roughness of 20 micrometers or greater, a moire phenomenon occurs at a particular scan frequency. More specifically, the basic function of a cathode-ray tube is to control an electron beam emitted from a cathode. This function is affected by adjusting the voltage of an electron gun composed of the cathode and other electrodes (grids). Here, if the surface of the cathode is not smooth, a difference between a voltage applied to the cathode and a voltage applied to a G1 (first grid) electrode occurs, thereby making it hard to demonstrate normal characteristics. In addition, when the cathode-ray tube is driven for a long time, sintering of the cathode progresses. Here, if the texture of the cathode is not dense, pores initially formed are collapsed and shrunk, increasing the distance between the cathode and the G1 (first grid) electrode. Consequently, the potential difference, which is set to control an emitted electron beam, between the cathode and the G1 (first grid) electrode changes, which causes deterioration of a life characteristic and degradation of brightness due to decreases in the amount of a charge emitted. On the contrary, when the electron emissive material layer of a cathode is excessively compressed, the high density of the electron emissive material layer increases a probability of the electron emissive material layer being detached from a base metal. In addition, the range of conditions of decomposing and aging (activating) the cathode is narrowed so that strict control is required during manufacturing processes.

SUMMARY OF THE INVENTION

It is therefore an object of the present invention to provide a cathode which can minimize a voltage difference due to a difference in the distance between the cathode and a G1 (first grid) electrode and which is improved in shrinking in the case of long operation, thereby improving life and electron emission characteristics and reducing degradation of brightness for an electron tube.

It is another object to provide a more efficient cathode.

It is another object to provide a cathode having improved compactness and surface evenness.

It is yet another object to provide a cathode that reduces or eliminates the moire phenomenon due to the roughness of the cathode.

To achieve the above objects, there is provided a cathode for an electron tube, including a base metal and an electron emissive material layer attached on the base metal, where a surface roughness, which is measured from the distance between a highest point and a lowest point of the surface of the electron emissive material layer, is controlled to be no greater than 8 μm (micrometers) and preferably no greater than 5 μm.

Preferably, the density of the electron emissive material layer is 2–5 mg/mm$^3$(milligrams per millimeters cubed).

Preferably, the thickness of the electron emissive material layer is 20–70 μm.

Preferably, the electron emissive material layer is attached on the base metal by one of a printing method and a deposition method.

More preferably, the electron emissive material layer is attached to the base metal by a screen printing method.

The cathode for an electron tube can be prepared by a method including the steps of preparing paste including 40–60% by weight carbonate powder, 30–50% by weight solvent, and 1–10% by weight binder, based on the total weight of the paste, attaching the paste on the base metal using one of screen printing and roll coating, and drying the resulting structure in the atmosphere at 100–300 degrees Celsius.

Preferably, the solvent is one selected from the group consisting of terpinol, butyl carbitol acetate, and a combination thereof.

Preferably, the binder is one of nitrocellulose and ethylcellulose.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
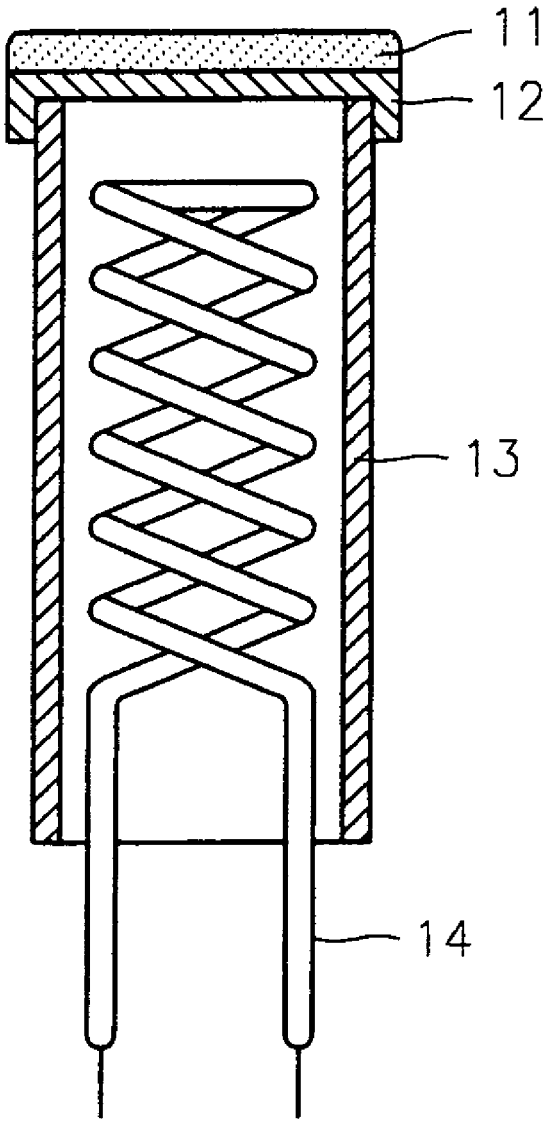
FIG. 1 is a schematic diagram of a typical cathode for an electron tube.

Turning now to the drawings, referring to FIG. 1, a general cathode includes a base metal 12 having the shape of a circular plate, a cylindrical sleeve 13 which is provided below the base metal 12 to support the base metal 12 and has a heater 14, i.e., a heating source of the cathode, therewith, and an electron emissive material layer 11 adhering to the top of the base metal 12.

An oxide cathode according to the present invention is characterized by a uniform size of an oxide particle, a uniform size of the pore (void) between oxide particles constituting an electron emissive material layer, a high density, and a small porosity, thereby having a compact texture and a high evenness.

While the density of an oxide cathode coated by a typical spraying method is 0.7–1.5 mg/mm$^3$ (miligrams per millimeters cube), the density of an oxide cathode according to the present invention is 2–5 mg/mm$^3$. As the density of an electron emissive layer increases, carbonate tends to come off. However, in the present invention, when the thickness T of an electron emissive layer 110 is less than about 70 μm (micrometers or microns), this problem does not occur. Preferably, the thickness of the electron emissive material layer is 20 to 70 μm. When the thickness of the electron emissive layer is less than 20 microns, the carbonate is not sufficient, which decreases the electron emission due to evaporation of Ba, while, when the thickness is over 70 microns, thermal transmission to the emitter can not be accomplished successfully, which causes decomposition of cathode.

While an oxide cathode layer according to a spraying method has a roughness of about 20 μm due to the cohesion between particles, an oxide cathode layer according to the present invention has a roughness of no greater than 8 μm (micrometers or microns) and preferably no greater than 5 μm, thereby having a uniform and compact surface. In addition, as for a cathode for an electron tube according to the present invention, oxide particles constituting an electron emissive material layer are distributed without cohesion, and the size of a pore is no greater than 8 μm (microns). Accordingly, a cathode according to the present invention has a uniform distribution of the sizes of particles and pores.

A cathode for an electron tube having such a structure has compactness 2–3 times better and surface roughness about 4 times better than a conventional cathode. Accordingly, the present invention provides a cathode with a high density and evenness. Consequently, the thickness of an electron emissive material layer can be greatly decreased, the shrinking of a cathode due to a long operation can be prevented, thereby improving a life characteristic and degradation of brightness, and defects caused by a difference between a voltage applied to a cathode and a voltage applied to a G1 (first grid) electrode can be prevented.

When an electron emissive material layer is attached to a base metal in an oxide cathode having an electron emissive material layer structure according to the present invention, any method applying predetermined pressure can be used. For example, a printing or deposition method can be used. The printing method is most preferable. Screen printing or roll coating can be used as the printing method. A painting method can also be used.

In an embodiment of the present invention, an electron emissive material layer is attached to a base metal by screen printing. As for screen printing, gauze formed of silk, nylon, TEFLON or stainless steel is fasten to a frame to form a screen, which is made to have a portion transmitting ink and a portion not transmitting ink. Therefore, printing is performed by extruding ink to a surface of an object, on which printing is performed, through the screen using a squeegee. Screen printing is characterized by a flexible screen, small printing pressure, and a thick ink coating so that printing can be performed regardless of the material of an object, on which printing is performed, and printing can be performed on a curved surface. Screen printing can be applied to various fields from paper to industrial printing such as plastic sheet and printed wiring boards.

In the embodiment of the present invention, printing is performed by a screen printing machine operating according to the above principle, using paste obtained by mixing the powder of a raw material having coprecipitated carbonate with appropriate binder and organic solvent, instead of using ink. Any carbonate widely used for preparing an oxide cathode can be used. For example, carbonate having a basic composition of (Ba, Sr, Ca)$CO_3$ or (Ba, Sr)$CO_3$ can be used. Preferably, the amount of carbonate contained in the printing mixture, i.e., the paste, is 40–60 wt. % (weight percent) based on the total weight of the paste. When the amount of carbonate is less than 40 wt. %, it is difficult to attain a desirable electron emission characteristic. When the amount of carbonate is greater than 60 wt. %, the fluidity of the mixture decreases, making uniform printing difficult.

A binder used in a typical spraying method can be used as the binder added to the printing mixture. For example, nitrocellulose or ethylcellulose can be used. Preferably, the amount of the binder is 1–10 wt. % based on the total weight of the paste. When the amount of the binder is less than 1 wt. %, adhesive strength decreases after drying. When the amount of the binder is greater than 10 wt. %, an electron emission characteristic is deteriorated due to a decrease in a degree of a vacuum within a cathode-ray tube decreases and residual carbon.

Since the printing mixture should be in a paste state, a highly volatile organic solvent used in a conventional spraying method cannot be used as the organic solvent added to the printing mixture. For example, terpinol, butyl carbitol acetate or a combination thereof can be used. Preferably, the amount of the organic solvent is 30–50 wt. % based on the total weight of the paste so that a paste state suitable for printing can be obtained. When the solvent is greater than 50% by weight, the emitter paste is too thin to apply in screen printing. Screen printing is difficult to perform with less than 30% by weight of emitter paste.

Figure 7:
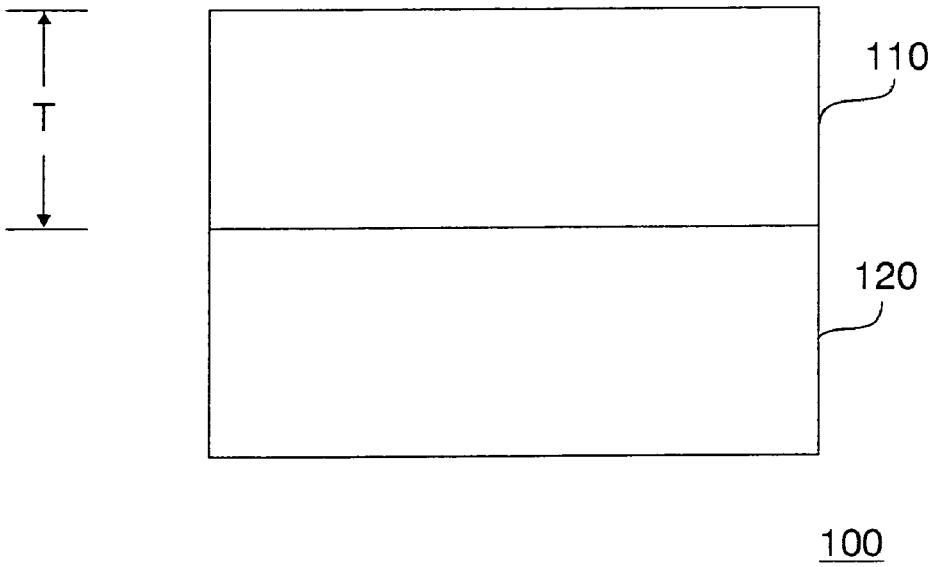
FIG. 7 illustrates the electron emissive material layer being attached to the base metal of the cathode of the present invention.
Figure 8:
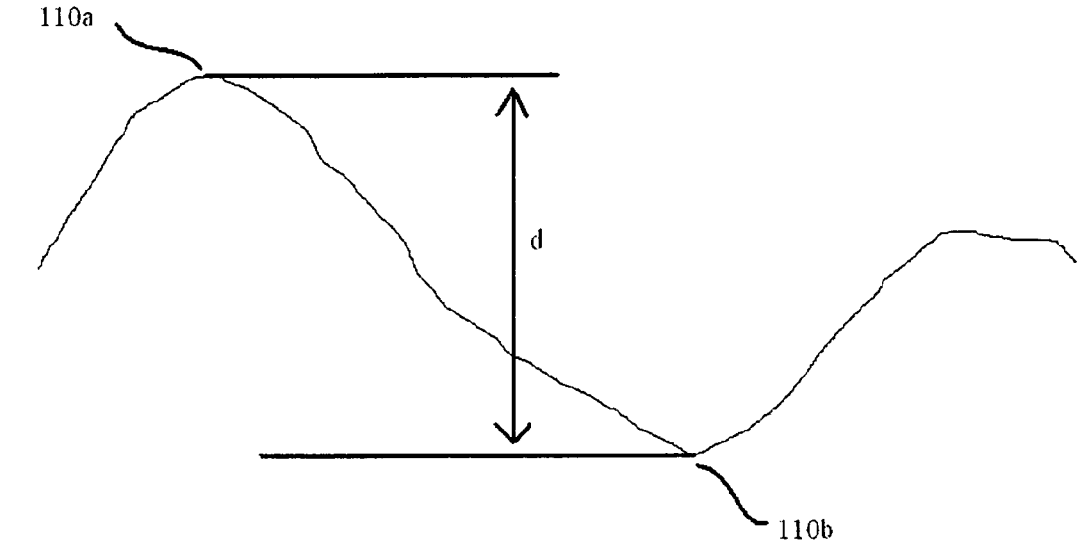
FIG. 8 illustrates the surface roughness of the electron-emitting material layer.

Referring to FIG. 7, the electron emissive material layer 110 with a thickness T is attached to the base metal 120 of the cathode 100 of the present invention. Further, as seen in FIG. 8, surface roughness of the electron-emissive material layer 110, which is measured as the distance "d" between the highest point 110*a* and the lowest point 110*b* on the surface of the electron-emitting material layer 110, is controlled to be no greater than 8 μm (micrometers), or preferably no greater than 5 μm, a variation in the voltage due to a difference in the distance between the cathode and the first grid, is minimized, and shrinkage of the cathode due to a long operating time of the cathode can be reduced.

Hereinafter, the effects of the general characteristics of a cathode for an electron tube according to the present invention will be described through embodiments.

<EXAMPLE 1>

60 g (grams) ternary carbonate, in which the percent by weight of Ba:Sr:Ca is 57:30:4, 1 g nitrocellulose, and 39 g terpinol was mixed using an agitator and a roll mill, thereby preparing printing paste. A base metal (cap) formed of nickel was coated with the paste using a screen printing machine (LS-34TV of NEWLONG in Japan). Printing pressure was 2–3 kgf/$cm^2$ (kilogram-force per centimeters square), and the distance between the mesh of the screen printing machine and the cap was about 1.5 mm (millimeters). The resulting structure was dried in the atmosphere at 150 degrees Celsius, thereby completing a cathode.

Figure 3:
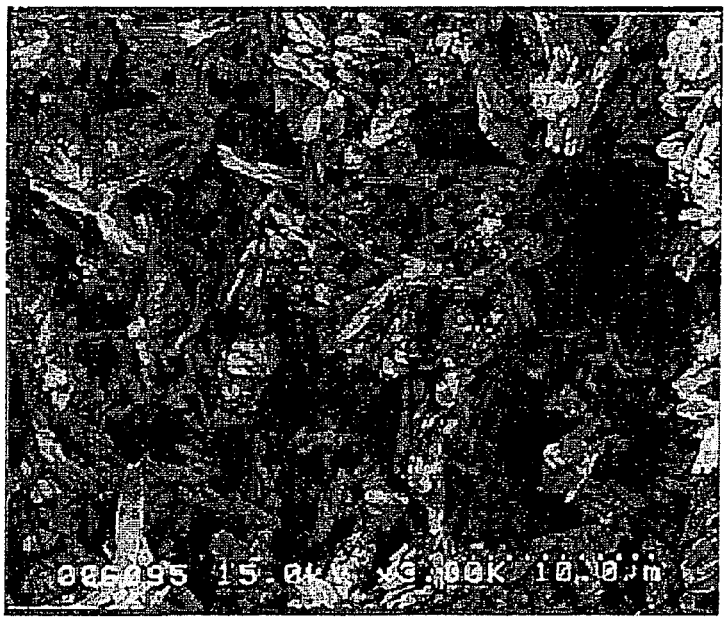
FIG. 3 is an electron microscopy photograph of the surface coating of the conventional cathode of FIG. 2, which is enlarged 2000 times.
Figure 4:
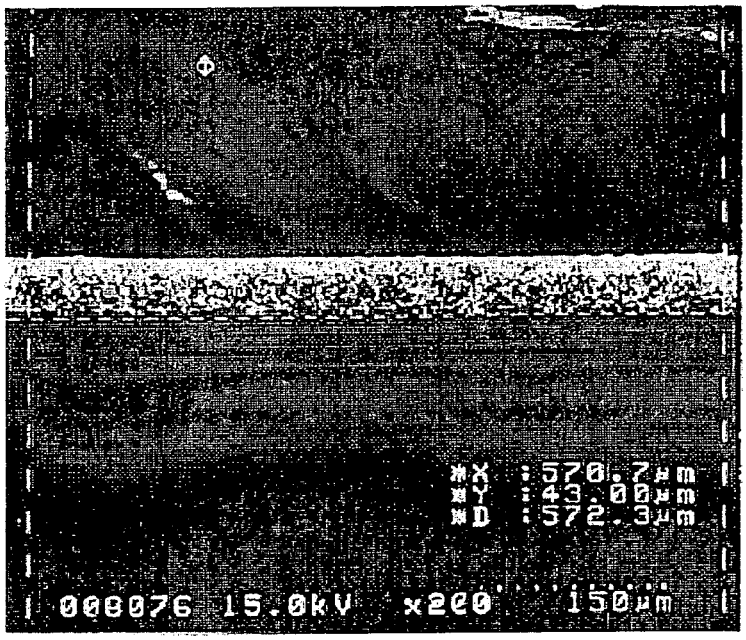
FIG. 4 is an electron microscopy photograph of the section of a cathode according to an embodiment of the present invention, which is enlarged 200 times.
Figure 5:
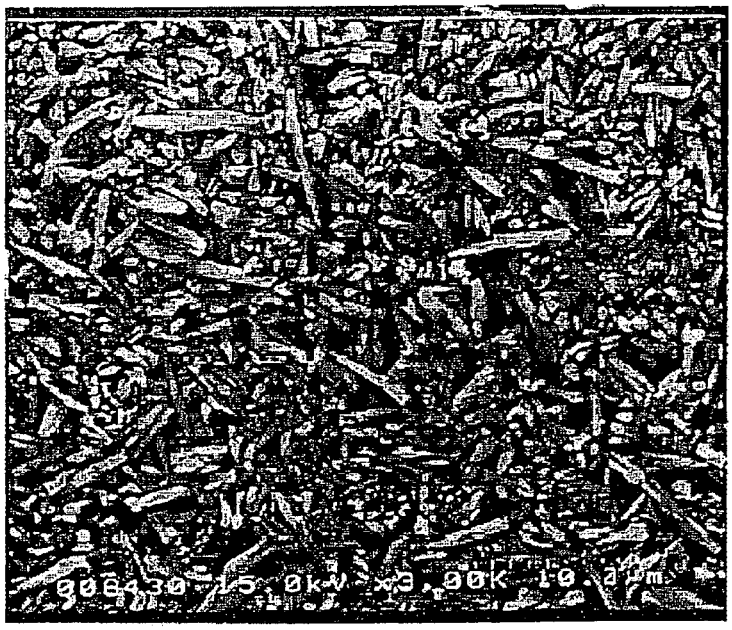
FIG. 5 is an electron microscopy photograph of the surface coating of the cathode of FIG. 4, which is enlarged 2000 times.

The section and surface texture of an electron emissive material layer of the cathode prepared above were observed through electron microscopy photographs. FIG. 4 is a photograph of the section enlarged 200 times, and FIG. 5 is a photograph of the surface texture enlarged 2000 times. As compared to FIGS. 2 and 3, the sizes of particles and pores are uniform, and the texture is compact.

<EXAMPLE 2>

A cathode was prepared in the same manner as in the first embodiment, with the exception that drying temperature was 300 degrees Celsius.

<COMPARISON EXAMPLE>

Figure 2:
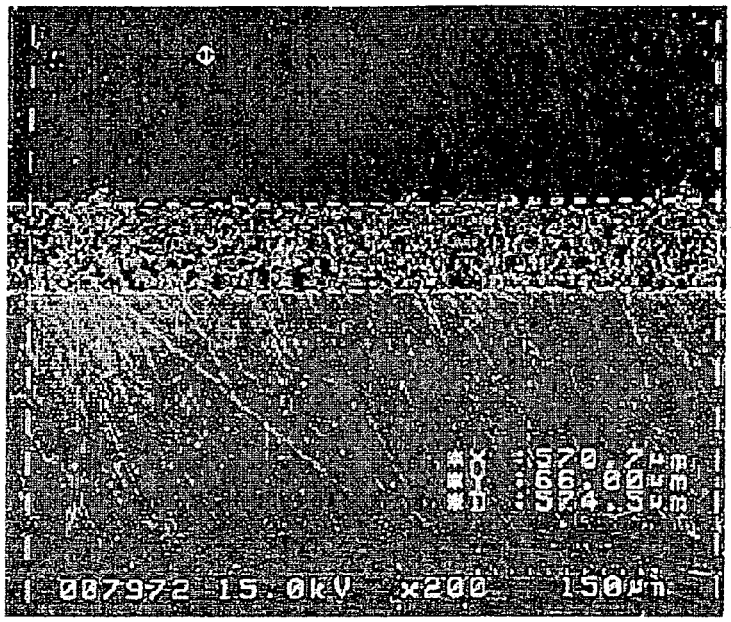
FIG. 2 is an electron microscopy photograph of the section of a conventional cathode, which is enlarged 200 times.

A composition typically used for spraying was prepared. The composition contained 40–50% by weight carbonate powder, 0.3–0.4% by weight nitrocellulose, 50–55% by weight isoamylacetate, and 5–5.5% by weight diethyloxalate. An electron emissive material layer was attached by a spraying method. A spray booth was maintained at a temperature of about 80 degrees Celsius and a pressure of 2–5 kgf/$cm^2$ (kilogram-force per centimeters square). The resulting structure was dried in the atmosphere at 150 degrees Celsius. The electron microscopy photographs of the section and surface texture of the electron emissive material layer are shown in FIGS. 2 and 3.

The characteristics of the cathodes prepared in the above Examples 1 and 2 and Comparison Example are analyzed as follows.

(1) Distribution of the Sizes of Pores

The distribution of the sizes of pores was obtained by measuring a ratio of the area of pores to a predetermined area in an about 2000-magnification electron microscopy photograph of each cathode. As a result, the cathodes of Examples 1 and 2 had pores of which the size was no greater than 5 μm, and the cathode of the comparison example had pores of which the size was about 20 μm.

(2) Distribution of the Size of an Aggregation of Particles

The aggregation of particles was observed from an about 2000-magnification electron microscopy photograph of each cathode. As a result, in the cathodes of Examples 1 and 2, carbonate particles having a size of 5–7 μm were separately distributed without aggregation. In the cathode of the Comparison Example, particles aggregated to a size of about 30–50 μm.

(3) Surface Roughness

The distance between a highest point 110*a* and a lowest point 110*b* was measured in an about 200 to 500-magnification electron microscopy photograph of the section of each oxide cathode. As a result, the distance was no greater than 8 μm in the cathodes of Examples 1 and 2, while the distance was 20 μm in the cathode of Comparison Example.

(4) Density

The weight of each cathode was measured before and after the coating of carbonate to calculate the weight of the carbonate coating. The area of the coating was multiplied by the thickness of the coating to calculate the volume of the coating. Thereafter, the density of the coating was calculated by dividing the weight of the carbonate coating by the volume of the coating. In the cathodes of Examples 1 and 2, the density was 2.0 mg/mm$^3$. In the cathode of the Comparison Example, the density was 1.05 mg/mm$^3$.

(5) Thermogravimetric Analysis (TGA)

Figure 6:
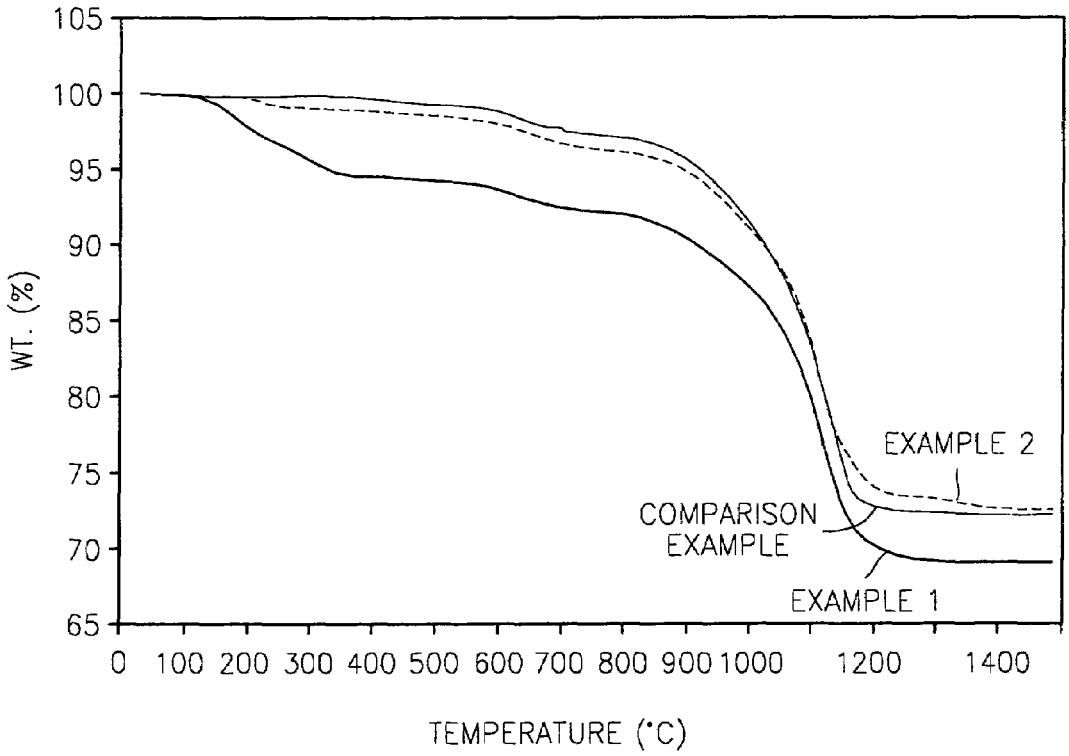
FIG. 6 is a graph of thermogravimetric analysis of cathodes prepared according to Examples 1 and 2 and Comparison Example.

A very small amount of printing carbonate paste was picked from each cathode and dried. Thereafter, TGA was performed. The equipment for TGA was an SDT 2960 of TA in the U.S. A temperature rising speed was 10° C./min (degrees Celsius per minute) in FIG. 6.

It appears that the cathodes prepared in Examples 1 and 2 of the present invention have a similar thermal decomposition characteristic to the cathode prepared according to the conventional spraying method, with the exception that an organic binder contained in the paste in each embodiment of the present invention is decomposed at about 300° C. It can be derived from this fact that a cathode according to the present invention can be applied to conventional processes of manufacturing a cathode-ray tube without changing manufacturing conditions much.

(6) Life Characteristic

A change in the IK (cathode current) of each cathode according to the passage of time was measured under accelerating conditions in which the voltage and initial current density of the heater of each cathode were set to 6.9 V and 3 A/cm$^2$. Therefore, the life characteristic of each cathode was estimated from the residual rate of IK for a predetermined time. Usually, the life of a cathode is defined by mean time to failure mode (MTTF), time which is taken for the residual rate of IK to reach 50%. While the life of the conventional cathode was 10,000–15,000 hours, the life of each cathode according to the present invention was 20,000–25,000 hours. It can be derived from this fact that the life of a cathode according to the present invention is markedly increased by 70% or greater compared to the life of a conventional cathode.

In addition, a decrease in evaporation of barium (Ba) and a decrease in a cut-off drift rate were nearly zero.

It is understood that improvement in life and cut-off voltage characteristics results from a voltage difference due to the nonuniform distance between a cathode and a G1 (first grid) electrode is minimized, and the subsidence and shrinking of pores within the cathode is prevented, even if the cathode is used for a long time. Moreover, the profile of an electron beam emitted from a cathode material having a relatively lower roughness has the shape of a spherical wave, which increases a beam spot, thereby eliminating a moire phenomenon due to the roughness of a cathode.

As described above, by controlling the sizes of particles and pores constituting an electron emissive material layer to be uniform and controlling the density and porosity of the electron emissive material layer, a cathode for an electron tube according to the present invention is improved in compactness and surface evenness compared to a cathode prepared according to a conventional spraying method. Accordingly, shrinking of a cathode during operation can be prevented, and the distance between the cathode and a G1 (first grid) electrode can be maintained uniform, so that the present invention greatly extends the life of a cathode and realizes a stable electron emission characteristic. Therefore, the present invention can markedly improve the life characteristic of a cathode even in an area of high current density attendant upon the high definition and large scale of recent television Braun tubes.

What is claimed is:

1. A cathode for an electron tube, comprising:

a base metal; and an electron emissive material layer attached on said base metal, said electron emissive layer including a surface roughness measured from a distance between a highest point and a lowest point of the surface of said electron emissive material layer, being controlled to be less than or equal to 8 microns, further comprised of the density of said electron emissive material layer being 2 to 5 mg/mm$^3$.

2. The cathode of claim 1, further comprised of the surface roughness distance being a maximum of not more than 5 microns.

3. The cathode of claim 1, further comprised of the thickness of the electron emissive material layer being from 20 to less than 70 microns.

4. The cathode of claim 1, further comprised of said electron emissive material layer being attached on said base metal by one method selected from the group consisting of printing and deposition, and said electron emissive material layer having a maximum surface roughness being from 5 to 8 microns.

5. The cathode of claim 1, further comprised of said electron emissive material layer being attached to said base metal by a screen printing method, and said electron emissive material layer including a plurality of surface roughness values and with a maximum value of surface roughness being 5 microns.

6. The cathode of claim 1, further comprised of said electron emissive material layer being attached to said base metal by a member selected from a group consisting of printing and deposition.

7. The cathode of claim 1, further comprised of said electron emissive material layer being attached to said base metal by a member selected from a group consisting of screen printing, painting and roll coating.

8. The cathode of claim 1, further comprised of said electron emissive material layer being applied to said base metal by applying a predetermined pressure.

9. A method of preparing the cathode for an electron tube of claim 1, the method comprising the steps of:

preparing a paste comprising 40 to 60% by weight carbonate powder, 30 to 50% by weight solvent, and 1 to 10% by weight binder, based on the total weight of said paste; and attaching said paste on said base metal using one member selected from the group consisting of screen printing, painting and roll coating.

10. The method of claim 9, further comprised of said solvent being one member selected from the group consisting of terpinol, butyl carbitol acetate, and a combination of terpinol and butyl carbitol acetate.

11. The method of claim 9, further comprised of said binder being one member selected from the group consisting of nitrocellulose and ethylcellulose.

12. A cathode for an electron tube, comprising:

a base metal; and an electron emissive material layer attached on said base metal, said electron emissive layer including a surface roughness measured from a distance between a highest point and a lowest point of the surface of said electron emissive material layer, being controlled to be a maximum of not more than 8 microns, with said electron emissive material layer comprising of oxide particles having a uniform size.

13. A cathode for an electron tube, comprising:

a base metal; and an electron emissive material layer attached on said base metal, said electron emissive layer including a surface roughness measured from a distance between a highest point and a lowest point of the surface of said electron emissive material layer, being controlled to be a maximum of not more than 8 microns, with said electron emissive material layer comprising of oxide particles having a uniform size of the pores between the oxide particles and the pores between the oxide particles being no greater than 8 microns.

14. A cathode for an electron tube, comprising:

a base metal; and an electron emissive material layer attached on said base metal, said electron emissive layer including a surface roughness measured from a distance between a highest point and a lowest point of the surface of said electron emissive material layer, being controlled to be not more than 8 microns, with said electron emissive material layer comprising of oxide particles having the pores between the oxide particles being no greater than 8 microns.

15. The cathode of claim 14, with said electron emissive material layer comprising of oxide particles having the pores between the oxide particles being no greater than 5 microns.

16. The cathode of claim 14, further comprised of a uniform distribution of the sizes of the oxide particles and pores.

17. A method of the cathode for the electron tube of claim 14, said method comprising the steps of:

mixing carbonate powder, solvent, and binder to form a paste;

applying said paste on a base metal of a cathode for an electron tube to form an electron emissive layer of said cathode, said paste to form an electron emissive layer for said cathode;

controlling a surface roughness measured from a distance between a highest point and a lowest point of the surface of said electron emissive material layer to be less than or equal to 8 microns.

18. A cathode for an electron tube, comprising:

an electron emissive material layer including a surface roughness measured from a distance between a highest point and a lowest point of the surface of said electron emissive material layer, being controlled to be not greater than 8 microns, further comprised of the density of said electron emissive material layer being 2 to 5 $mg/mm^3$.

19. A cathode for an electron tube, comprising:

an electron emissive material layer including a surface roughness measured from a distance between a highest point and a lowest point of the surface of said electron emissive material layer, being controlled to be not greater than 8 microns, with said electron emissive material layer comprising of oxide particles having the pores between the oxide particles being no greater than 8 microns.

20. The cathode of claim 19, with said electron emissive material layer comprising of a carbonate powder, a solvent and a binder mixed with said carbonate powder and said solvent, the carbonate particles having a size of 5 to 7 microns being separately distributed without aggregation.

21. A cathode for an electron tube, comprising:

an electron emissive material layer including a surface roughness measured from a distance between a highest point and a lowest point of the surface of said electron emissive material layer, being controlled to be not greater than 8 microns, with said electron emissive material layer comprising of oxide particles having the pores between the oxide particles being no greater than 5 microns.

22. A cathode for an electron tube, comprising:

an electron emissive material layer including a surface roughness measured from a distance between a highest point and a lowest point of the surface of said electron emissive material layer, being limited to be a maximum of not greater than 8 microns, further comprised of a uniform distribution of the sizes of the oxide particles and pores.

23. A method of a cathode for an electron tube, said cathode comprising of a base metal, and an electron emissive material layer attached on said base metal, said method comprising the steps of:

mixing carbonate powder, solvent, and binder to form a paste;

applying said paste on a base metal of a cathode for an electron tube to form an electron emissive layer of said cathode, said paste to form an electron emissive layer for said cathode;

controlling a surface roughness measured from a distance between a highest point and a lowest point of the surface of said electron emissive material layer to be a maximum of not more than 8 microns, further comprised of forming the density of said electron emissive material layer being 2 to 5 $mg/mm^3$.

24. A method of a cathode for an electron tube, said cathode comprising of a base metal, and an electron emissive material layer attached on said base metal, said method comprising the steps of:

mixing carbonate powder, solvent, and binder to form a paste;

applying said paste on a base metal of a cathode for an electron tube to form an electron emissive layer of said cathode, said paste to form an electron emissive layer for said cathode;

controlling a surface roughness measured from a distance between a highest point and a lowest point of the surface of said electron emissive material layer to be a maximum of not more than 8 microns, further comprising of forming said electron emissive material layer comprising of oxide particles having the pores between the oxide particles being no greater than 8 microns.

* * * * *